United States Patent [19]

Pedroso et al.

[11] 4,211,501

[45] Jul. 8, 1980

[54] SPREADING TOOL

[76] Inventors: Rosa M. Pedroso; Raul I. Pedroso, both of 4120 S.W. 96th Ave., Miami, Fla. 33165

[21] Appl. No.: 957,571

[22] Filed: Nov. 3, 1978

[51] Int. Cl.[2] ..... E04F 21/30; E04F 21/32

[52] U.S. Cl. ..... 401/261; 15/235.7; 15/236 R; 15/245; 222/541; 401/265; 425/458

[58] Field of Search ..... 401/5, 9–12, 401/193, 261, 265; 222/566, 541; 15/104 S, 105.5, 235.3–235.8, 236, 245; 425/458

[56] References Cited

U.S. PATENT DOCUMENTS

| | | | |
|---|---|---|---|
| 756,771 | 9/1929 | Pietila | 15/235.4 X |
| 2,065,886 | 12/1936 | Clift | 15/245 |
| 2,188,114 | 1/1940 | Hubbard | 15/245 |
| 2,591,301 | 4/1952 | Schacht | 15/245 |
| 2,988,775 | 6/1961 | Painter et al. | 401/261 |
| 3,119,138 | 1/1964 | Davis | 15/245 X |
| 3,267,516 | 8/1966 | Eckhaus | 18/3.5 |
| 3,485,236 | 12/1969 | Frost | 15/104 S |
| 3,744,079 | 7/1973 | Krause | 15/235.7 |
| 3,761,992 | 10/1973 | Schneller | 15/245 X |
| 3,846,060 | 11/1974 | Otis | 15/235.7 X |
| 3,878,581 | 4/1975 | Perna | 15/235.3 X |

FOREIGN PATENT DOCUMENTS

| | | | |
|---|---|---|---|
| 2220813 | 11/1972 | Fed. Rep. of Germany | 425/458 |

*Primary Examiner*—Edgar S. Burr
*Assistant Examiner*—Steven A. Bratlie
*Attorney, Agent, or Firm*—Oltman and Flynn

[57] ABSTRACT

Disclosed is a tool for use in spreading soft, malleable materials along an inner corner formed by angular surfaces. The tool has a relatively hard core and an elastomeric covering on the core together forming a spreading nose for the tool. The tool has a handle for the spreading nose. The elastomeric covering is a soft, resilient material so that it will seal against the angular surfaces of the inner corner where the material is being spread, even if those surfaces are somewhat irregular, for confining the soft spreading material and inhibiting it from spreading around a working edge of the tool except at a tip where a bead is formed.

7 Claims, 10 Drawing Figures

SPREADING TOOL

BACKGROUND OF THE INVENTION

There is a need for a tool for spreading soft malleable materials such as caulking or sealing materials. Such soft materials will sometimes be referred to herein as spreading materials. Such materials have typically been spread and smoothed with the finger. A purpose of using the spreading material is to seal a possible crack existing between two wall surfaces forming an inner corner. For example, the inner corner may be formed by a window frame mounted in a concrete wall opening. The spreading material should be applied and pressed against the walls evenly without leaving unwanted residues or an uneven surface on the sealing bead. Caulking tools have previously been proposed, for example in U.S. Pat. No. 3,267,516-Eckhaus and 3,744,079-Krause. A problem with such tools is that no effective way is provided to prevent escape of the spreading material around the tool, and this can result in unwanted residues and uneven sealing beads when the spreading material is spread.

SUMMARY OF THE INVENTION

The spreading tool of the present invention has a relatively hard core and an elastomeric covering on the core which has sufficient resiliency at the working edge of the tool to seal against the angular surfaces of an inner corner where material is to be spread, even if those surfaces are somewhat irregular, for substantially confining any excess of soft, malleable material being spread to the desired area on the tool and inhibiting that material from spreading widthwise excessively. In a preferred embodiment, the core and elastomeric covering form a nose and a handle for the nose, and the elastomeric covering at the nose tapers inwardly and longitudinally to a relatively narrow tip having a relatively thin working edge for engaging the angular surfaces. The working edge has a portion which is blunted sufficiently widthwise to form a bead of soft, malleable material at the corner. The elastomeric covering is resilient and sufficiently thick and sufficiently soft at the working edge to seal very effectively against the angular surfaces to prevent escape of the spreading material around the working edge except at the bead.

Accordingly, it is an object of the present invention to provide a spreading tool which will seal against the angular surfaces of an inner corner so that the tool does not leave unwanted residues when spreading a bead of spreading material in the corner.

Another object of the invention is to confine the spreading material to the working area of the tool so that it does not spread widthwise excessively but does form a uniform bead.

Other objects of this invention will appear from the following description and appended claims, reference being had to the accompanying drawings forming a part of this specification wherein like reference characters designate corresponding parts in the several views.

Figure 6:
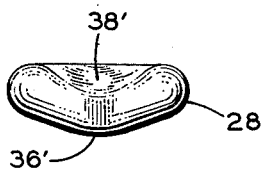
FIG. 6 is an end elevational view showing another possible modification of the tool of FIG. 1.
Figure 1:
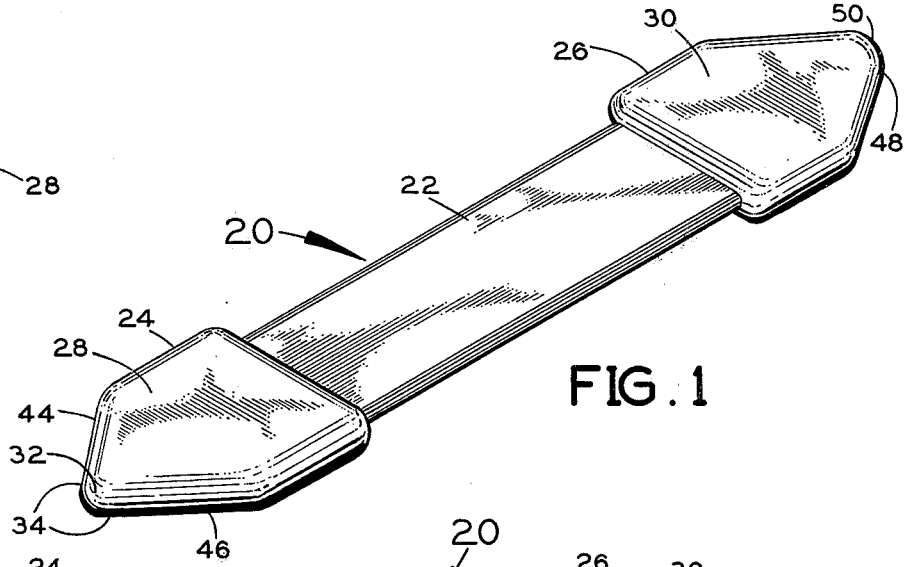
FIG. 1 is a perspective view of a spreading tool in accordance with a preferred embodiment of the invention.
Figure 2:
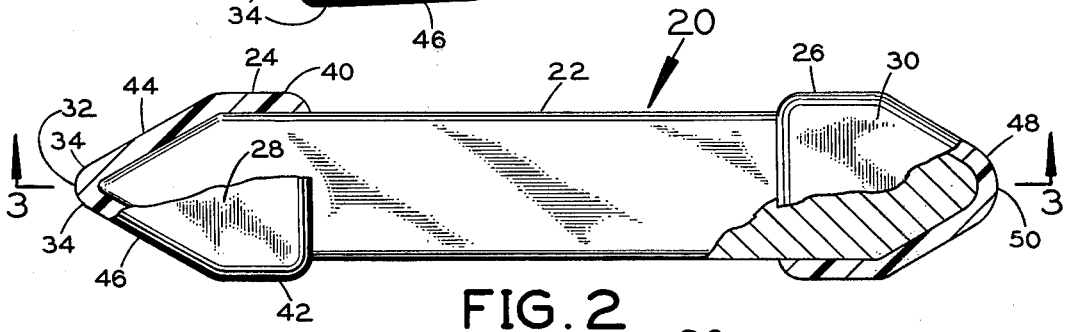
FIG. 2 is a top plan view of the tool of FIG. 1, with portions broken away to illustrate the construction.
Figure 3:
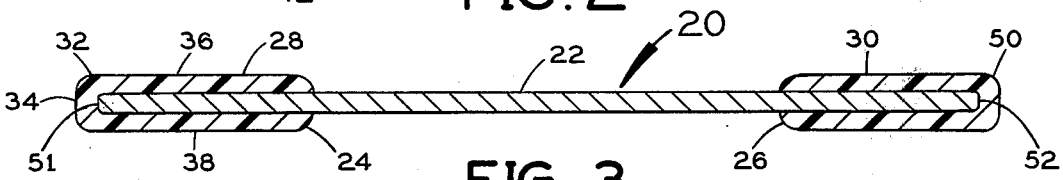
FIG. 3 is a longitudinal sectional view taken along line 3—3 of FIG. 2.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DESCRIPTION

Referring first to FIGS. 1 through 4, the spreading tool 20 includes a relatively hard core 22, an elastomeric covering 24 at the left end of the core 22, and another elastomeric covering 26 at the right end of the core 22. The covering 24 and the core 22 form a left nose 28 for the tool, and the covering 26 and the core 22 form a right nose 30 for the tool. In this embodiment, the intermediate portion of the core 22 forms a handle for the tool.

The elastomeric covering 24 at the nose 28 tapers inwardly and longitudinally to a relatively narrow tip 32 having a relatively thin working edge 34 for engaging the angular surfaces of an inner corner. The whole tool 20 is relatively flat, and the noses 28 and 30 are relatively flat. The left nose 28 has parallel, planar major surfaces 36 and 38 joined by sides 40 and 42. In section the sides 40 and 42 are shown as mostly straight with rounded corners, but they may have a full radius. The sides could be inclined. The working edge 34 has converging portions 44 and 46 forming an apex angle typically in the range from 20 to 90 degrees. In the illustrated embodiment of FIGS 1–4, the apex angle is about 60 degrees. The working edge 34 at the tip 32 is blunted sufficiently widthwise to form a bead of soft malleable material at the corner where the material is being spread. In the embodiment of FIGS. 1 through 4, the working edge at the tip 32 is rounded. Surface 36 or 38 may face the inner corner. When the surface 38 faces the corner, the lower end of the working edge 34 makes contact with the angular surfaces, and vice versa when surface 36 faces the corner.

The elastomeric coverings 24 and 26 should have sufficient resiliency and be sufficiently soft to make an effective seal with the angular surfaces at the corner where the material is being spread. Thermoplastic elastomers would probably be less expensive in fabrication, but thermosetting elastomers typically have better mechanical properties. Preferably, the elastomeric coverings 24 and 26 have a durometer hardness in the range from 20 to 70 Shore A. The elastomeric coverings can be fabricated from a variety of elastomers including foam. Examples are silicone rubber, chloreprene, nitrile, and polyisoprene. The elastomeric covering should be sufficiently thick to be soft for sealing purposes, and a thickness of ⅛ inch is satisfactory for a tool about 6 and ¼ inches long. The radius of the working edge 34 at the tip 32 may be about ¼ inch for the left nose 28.

The right nose 30 is preferably identical to the left nose 28 except that the radius of the working edge 48 at the tip 50 of the right nose 30 is greater, say about 5/16 inch, to make it more blunt than the left nose to leave more spreading material forming a larger bead. In all other respects, the description of the left nose 28 applies to the right nose 30.

The core 22 is made of a relatively hard material such as metal, wood or plastic. The left end of the core 22 conforms generally with the shape of the nose 28, and the right end of the core 22 conforms generally with the shape of the nose 30. In the illustrated embodiment, the tip 51 at the left end of the core 22 has a radius of ⅛ inch, and the tip 52 at the right end of the core 22 has a radius of 3/16 inch. The core gives stability and support to the elastomeric coverings and, as previously mentioned, serves as a handle.

Figure 4:
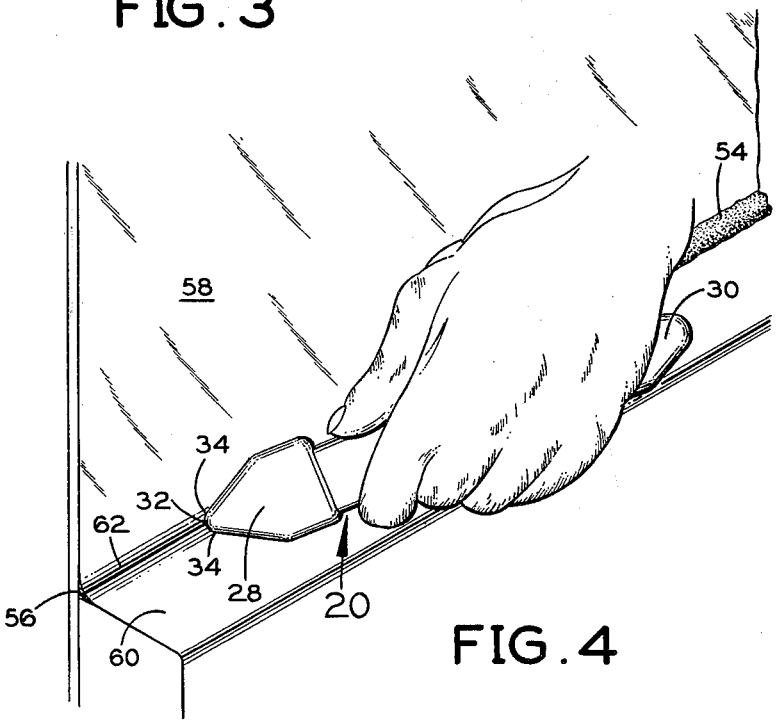
FIG. 4 is a perspective view illustrating the usage of the tool of FIG. 1.

FIG. 4 illustrates the usage of the spreading tool. Spreading material 54 is applied relatively roughly to an inner corner 56 which is formed by two angular surfaces 58 and 60 that may be surfaces of a window and a frame respectively, by way of example. The corner surfaces need not be at a right angle. The spreading material 54 is caulking material in this illustration. The spreading tool 20 is grasped at the handle, and the nose 28 is inserted into the corner 56 so that the working edge 34 engages the surfaces 58 and 60, and the tip 32 engages the spreading material 54 at the corner 56. The tool is manually pulled along the corner 56 in the position shown in FIG. 4 so that the tool leaves a bead 62 of spreading material behind it. Since the working edge 34 seals against the surfaces 58 and 60, no spreading material escapes past the working edge except at the tip 32 where the working edge is blunted to form a bead. The nose 28 tends to confine the spreading material so that it does not spread widthwise excessively on the tool surface.

In use, the tool is inclined. The smaller the apex angle, the more the tool needs to be inclined in use, such that the working edge seals well against the angular surfaces.

Figure 5:
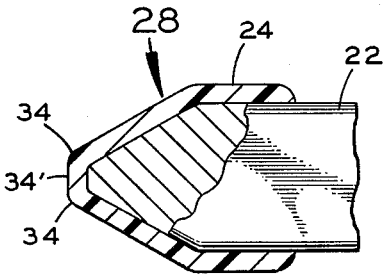
FIG. 5 is a fragmentary view showing a possible modification of the tool of FIG. 1.

FIG. 5 shows a possible modification of the left nose 28 wherein the blunted portion of the working edge 34 at the tip 32 is flat as shown at 34'. Such a flattened nose may be desirable for some applications. The same modification is possible for the right nose 30.

FIG. 6 shows another possible modification of the nose wherein one of the major surfaces 38' of the nose 28 is concave for more effectively confining spreading material. The surface 38' would be used as the under surface of the tool in a spreading application.

Figure 7:
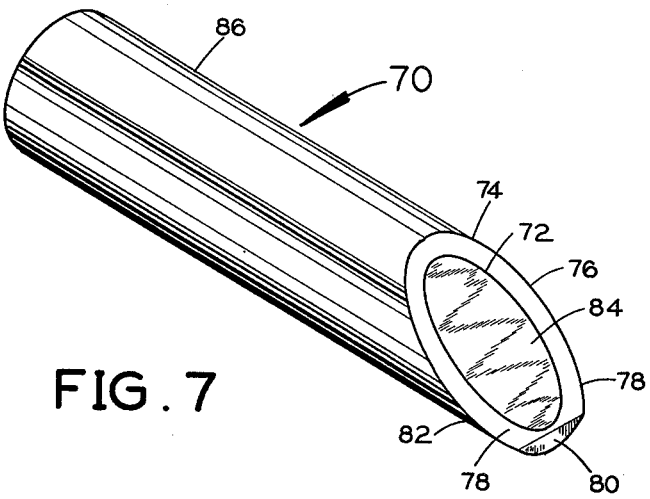
FIG. 7 is a perspective view of another embodiment of the invention in which the tool is rounded.

In FIG. 7, the tool 70 is generally round. The tool has a relatively hard core 72, and an elastomeric covering 74 on the core 72. The nose of the tool is at 76, and the nose 76 has a working edge 78 which tapers down inwardly and longitudinally to a relatively narrow tip 80. The working edge may be rounded. One major surface 82 of the nose 76 is rounded and the other major surface 84 is at an acute angle to the axis of the tool so that the tip 80 and working edge 78 are relatively thin. The working edge 78 at the tip 80 is blunted sufficiently widthwise to form a bead of soft malleable material at the corner where the material is being spread. FIG. 7 shows said blunted tip 80 being flat, but it may be rounded. The surface 84 normally faces away from the inner corner when the tool is being used. The covering 74 and core 72 constitute a handle at area 86 for manipulation of the tool. The covering need not extend to area 86. The elastomeric covering has sufficient softness and resiliency at the working edge 78 to seal against the angular surfaces of the inner corner where the tool is used, even if said surfaces are somewhat irregular, for substantially confining the soft spreading material and inhibiting that material from spreading widthwise around the working edge except at the bead.

The tool of FIG. 7 can also be used inverted; that is, with surface 84 facing the inner corner where soft malleable material is being spread. The space remaining between surface 84 and the inner corner forms a bead of spreading material. The working edge 78 of the elastomeric covering 74 seals against the angular surfaces for substantially confining any excess of soft, malleable material to surface 84 on the tool and inhibiting said material from spreading widthwise excessively.

Figure 8:
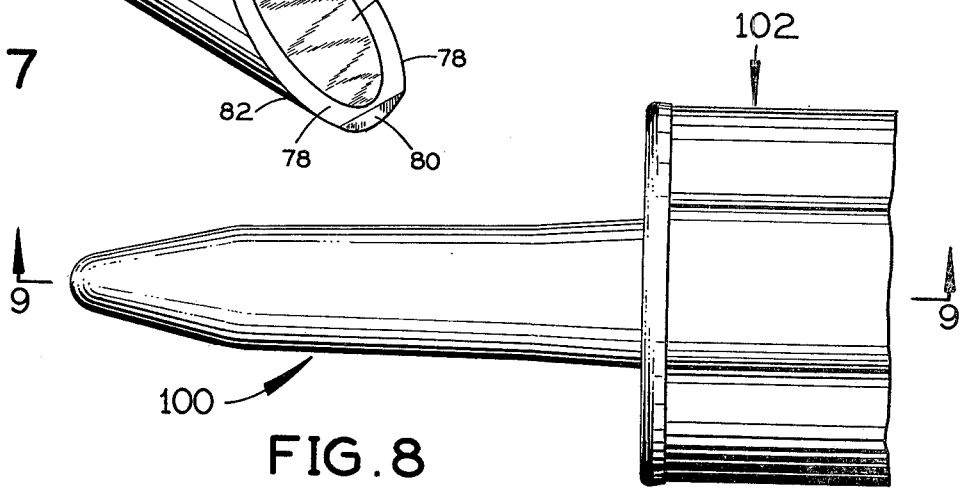
FIG. 8 is an elevational view of another embodiment wherein the tool is attached to the container of spreading material.
Figure 9:
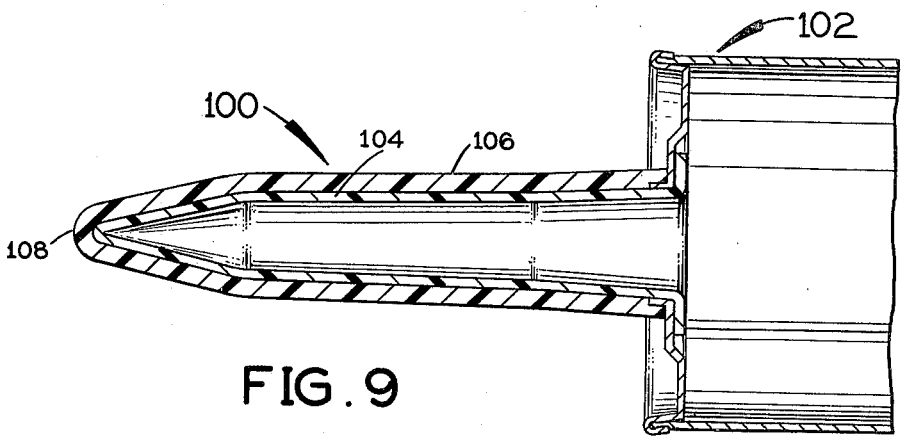
FIG. 9 is a sectional view taken along line 9—9 of FIG. 8.
Figure 10:
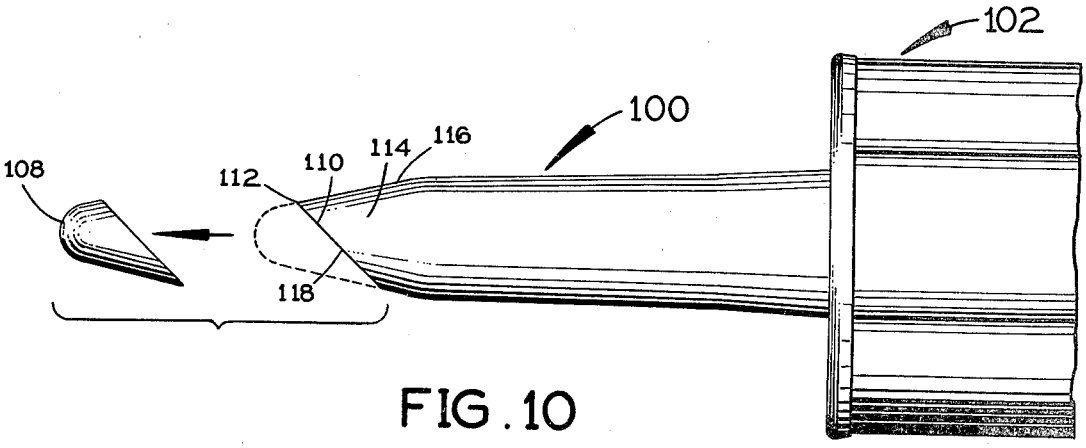
FIG. 10 illustrates the removal of a tip of the tool of FIG. 8 to form a working edge.

FIGS. 8 through 10 illustrate another embodiment which in some respects is similiar to the embodiment of FIG. 7. The tool 100 is attached to a container 102 for spreading material such as caulking material, and serves not only as a spreading tool, but also as a spout for the container. The core 104 is a hollow, relatively hard tube as shown in FIG. 9. The material of the core could, for instance, be metal, plastic or wood. The elastomeric covering 106, which may be the same material as described in connection with FIGS. 1–7, can cover the entire outer surface of the core 104. In FIG. 8, the core and covering are closed at the left end 108, but before the tool is used, the end 108 is cut off at an angle as shown in FIG. 10 to form a tapered working edge 110 which is the same as the edge 78 in FIG. 7. Thus, the working edge engages the angular surfaces at the corner and tapers down inwardly and longitudinally to a narrow thin tip 112. The elastomeric covering 106 seals against the angular surfaces of the inner corner due to its softness and resiliency. One surface 116 of the nose 114 is rounded, and the other surface 118 is at an angle to the axis of the tool so that the tip 112 and the working edge 110 at the tip 112 are relatively thin. The container 102 forms a handle for the tool in this embodiment. The spreading material is ejected from the container through the tool, and then the tool is manipulated in the same manner as illustrated in FIG. 4 to spread the spreading material in the corner. The surface 118 faces the inner corner when the tool is being used.

Any of the embodiments could have a substantially longitudinal hole for ejecting material and serving as a spout. The handle would serve as a container as in FIG. 8–10.

The elastomeric covering in any of the embodiments could be impregnated or coated with lubricant. The elastomeric covering may be molded on the core after it is coated with primer and adhesive, or it may be molded as a separate piece or pieces and attached to the core with adhesive.

Having thus described my invention, I claim:

1. A tool for use in spreading soft, malleable material along an inner corner formed by angular surfaces, comprising:

a hard core with an elastomeric covering, having a durometer hardness in the range from 20 to 70 Shore A, on said core together forming a spreading nose for said tool;

a handle for said spreading nose;

said elastomeric covering tapering inwardly and longitudinally, forming an apex angle in the range from 20 to 90 degrees, to a narrow tip;

said elastomeric covering having a working edge with longitudinally converging portions for engaging the angular surfaces of the inner corner;

said working edge having a blunt tip to form a bead of soft malleable material at said corner;

said elastomeric covering supporting said working edge having substantially uniform thickness of up to substantially ⅛ inch and said core providing substantially uniform support to said working edge such that said elastomeric covering compresses and said working edge conforms and seals against the angular surfaces, even if said angular surfaces are somewhat irregular, when said spreading nose is pressed and pulled along the inner corner for substantially confining said soft malleable material to said spreading nose and a uniform bead formed by the blunt tip of said working edge at the inner corner.

2. The tool of claim 1 in which:

said elastomeric covering has two substantially parallel planar major surfaces joined by sides;

portions of said sides tapering inwardly and longitudinally to a substantially narrow tip;

said elastomeric covering forming said working edge along the junction of said planar major surfaces and said sides;

said working edge having substantially straight converging portions joined by said blunt tip.

3. The tool of claim 1 in which:

said elastomeric covering has two major surfaces joined by sides;

portions of said sides tapering inwardly and longitudinally to a substantially narrow tip;

one said major surface being concave for better confining said soft malleable material;

said elastomeric covering forming said working edge along the junction of said concave major surface and said sides;

said working edge having longitudinally coverging portions joined by said blunt tip.

4. The tool of claim 1 in which:

said elastomeric covering has one major surface substantially round and another major surface substantially flat at an acute angle to said round surface;

said elastomeric covering forming said working edge along the intersection of said round major surface and said flat major surface;

said working edge having longitudinally converging portions joined by said blunt tip.

5. The tool of claim 1 in which:

said elastomeric covering is impregnated with lubricant.

6. The tool of claim 1 in which:

said handle is a container of soft malleable material; said core having a hole serving as a spout.

7. The tool of claim 1 in which:

said core has a second spreading nose with a second elastomeric covering, having a durometer hardness in the range from 20 to 70 Shore A, thereon at an opposite end thereof;

said second elastomeric covering tapering inwardly and longitudinally, forming an apex angle in the range from 20 to 90 degrees, to a second substantially narrow tip;

said second elastomeric covering having a second working edge with longitudinally coverging portions for engaging the angular surfaces of the inner corner;

said second working edge having a blunt tip to form a bead of soft malleable material at the inner corner;

said second elastomeric covering supporting said second working edge having substantially uniform thickness of up to substantially ⅛ inch and said core providing substantially uniform support to said second working edge such that said second elastomeric covering compresses and said second working edge conforms and seals against the angular surfaces, even if said angular surfaces are somewhat irregular, when said spreading nose is pressed and pulled along the inner corner for substantially confining said soft malleable material to said second spreading nose and a uniform bead formed by the blunt tip of said second working edge at the inner corner.

* * * * *